United States Patent [19]

Weston

[11] 4,087,664

[45] May 2, 1978

[54] HYBRID POWER CIRCUIT BREAKER

[75] Inventor: Donald E. Weston, Lansdale, Pa.

[73] Assignee: I-T-E Imperial Corporation, Spring House, Pa.

[21] Appl. No.: 609,161

[22] Filed: Aug. 29, 1975

[51] Int. Cl.[2] ..... H01H 33/14; H01H 33/66

[52] U.S. Cl. ..... 200/145; 200/144 B

[58] Field of Search ..... 200/145, 144 B

[56] References Cited

U.S. PATENT DOCUMENTS

| | | | |
|---|---|---|---|
| Re. 27,625 | 4/1973 | Weston | 200/145 |
| 3,244,842 | 4/1966 | Kameyama et al. | 200/144 B |
| 3,303,309 | 2/1967 | Flurscheim et al. | 200/144 B |

*Primary Examiner*—Robert S. Macon

*Attorney, Agent, or Firm*—Ostrolenk, Faber, Gerb & Soffen

[57] ABSTRACT

A hybrid circuit breaker consists of a series-connected vacuum interrupter and sulfur hexafluoride interrupter wherein the contacts of each are simultaneously operated. The sulfur hexafluoride interrupter is of the type in which an arc is rapidly rotated through a relatively static volume of sulfur hexafluoride. In one embodiment of the invention, the vacuum interrupter is replaced by a second sulfur hexafluoride interrupter in which the arc gap between the electrodes receiving the final arc to be interrupted is relatively smaller than the corresponding arc gap in the other sulfur hexafluoride interrupter.

5 Claims, 2 Drawing Figures

FIG. 1
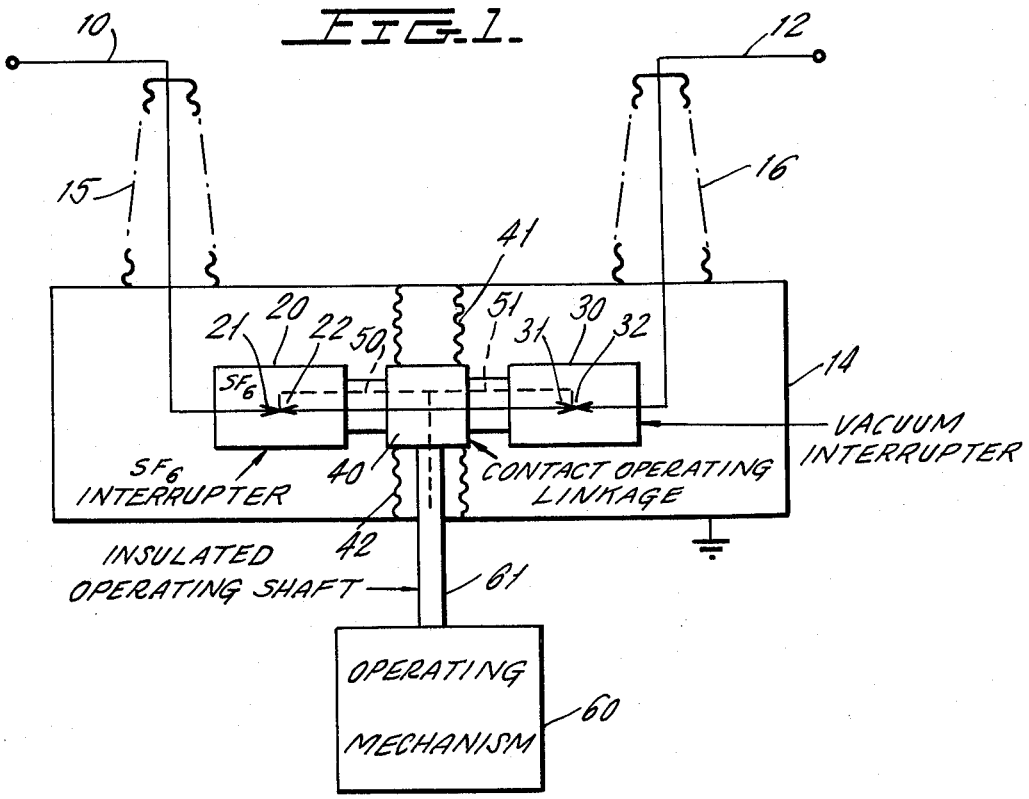
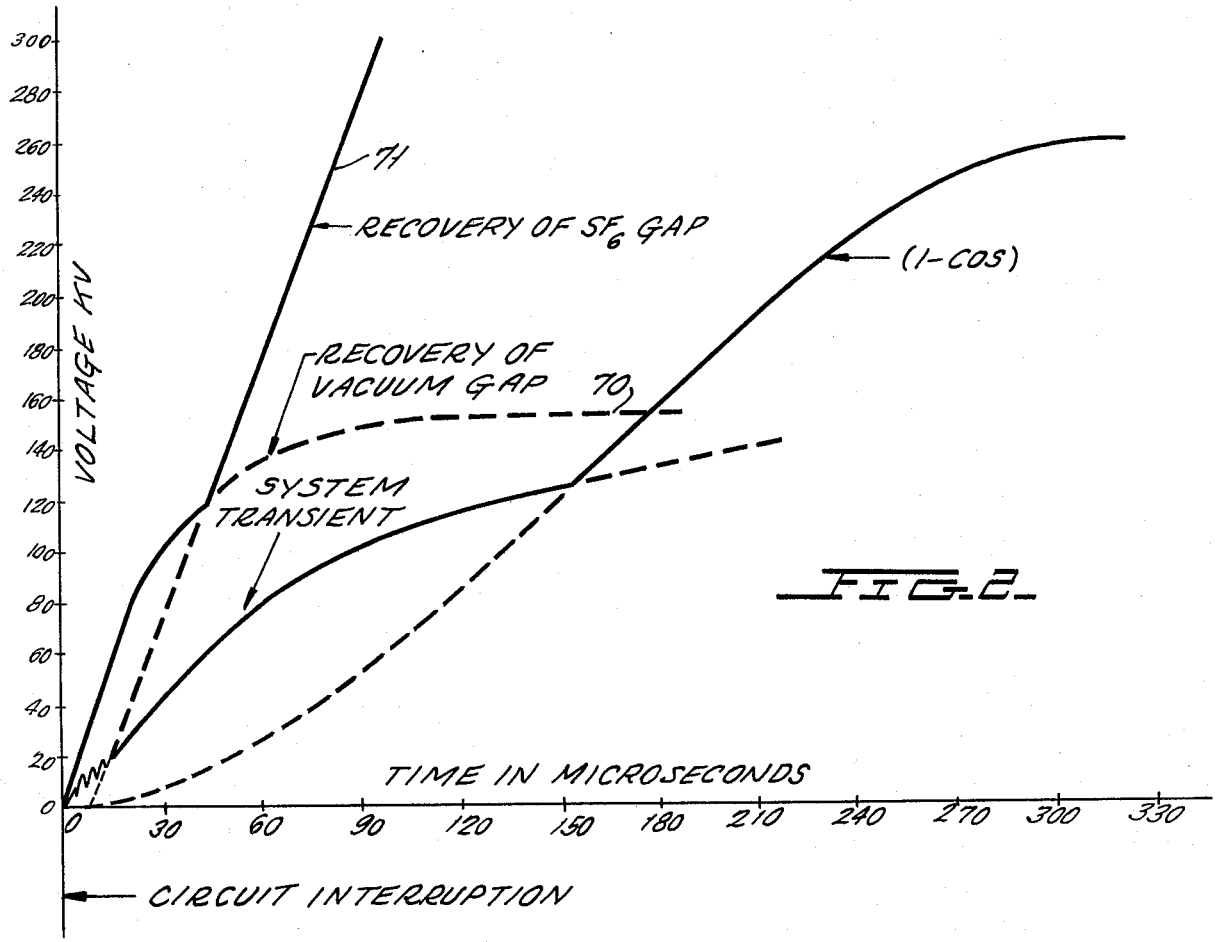
FIG. 2

HYBRID POWER CIRCUIT BREAKER

RELATED APPLICATIONS

This application is related to copending application Ser. No. 609,160, filed Aug. 29, 1975 in the name of D. E. Weston, entitled $SF_6$ PUFFER FOR ARC SPINNER, and assigned to the assignee of the present invention.

BACKGROUND OF THE INVENTION

This invention relates to a hybrid circuit breaker, and more particularly to diversely constructed series-connected circuit interrupters of diverse types, particularly a sulfur hexafluoride interrupter of a first configuration and either a vacuum interrupter or a sulfur hexafluoride interrupter of a second configuration.

Various types of interrupters are well known, each having particular advantages and disadvantages. It is known to combine diverse types of interrupters in order to gain the advantages of each in a combined circuit breaker. Examples of such combinations are shown in U.S. Pat. No. 3,814,882 where individual interrupters are sequentially opened rather than being simultaneously opened; and U.S. Pat. No. 3,227,924 where the specific interrupters disclosed include an air blast interrupter and an oil-poor interrupter wherein the advantages of each are obtained in the aggregate in the series combination.

BRIEF DESCRIPTION OF THE INVENTION

In accordance with the invention, specific interrupters are connected in series, and are simultaneously operated and include a vacuum interrupter and an $SF_6$ interrupter. The combination of the two diverse types of interrupters does not simply display the best advantages of each, in an aggregative or cumulative way, but a synergistic relationship exists wherein the completed hybrid circuit breaker displays characteristics which are superior to the characteristics of either individual interrupter. Thus, the combination of a simultaneously operated vacuum interrupter and an $SF_6$ interrupter exploits the strength of each and compensates for the weakness of each.

The greatest strength of vacuum interrupters is their inherent ability to recover dielectric strength across the interrupting gap at the time of current zero. When the conducting arc is in the vacuum arc mode at the time of current zero, the dielectric recovery is faster than it is for any other interrupting medium known.

There are three weaknesses of vacuum interrupters:

(1) Under continuous voltage stress, they may experience random dielectric breakdown across open contacts, accidentally energizing the system they are isolating. The breakdown is momentary — not greater than ½ cycle of the system frequency — and it is non-damaging to the vacuum interrupter. It is an unscheduled operation.

(2) Butt contacts of a vacuum interrupter may bounce on closing. When this occurs on an energized system, multiple circuit make and break operations can occur because of the efficient interrupting capability of vacuum. On some circuits, multiple make-break operations may produce voltage above the insulation level of the system and equipment.

(3) Vacuum interrupters randomly "chop" the current as the current approaches zero during circuit interruption. On some circuits this current chopping can generate high voltages. The magnitude of the voltage is related to the product of the instantaneous value of the current at the time of chopping and the surge impedance of the system being switched. These voltages can be large when compared to a system voltage of 15 kV, 34.5 kV and below. The voltages generated are small compared to the insulation level of systems of 69 kV and above. Application at 121 kV and above the effects of current chopping can be ignored and considered harmless.

A gap in $SF_6$ has reliably high dielectric recovery capability following thermal recovery and reliably high dielectric withstand under continuous voltage stress. The dielectric withstand ability can isolate the vacuum interrupters from the system and prevent random breakdown of the gap.

It is possible in $SF_6$ to use wiping contacts of the tulip and bayonet type. The contacts can make a circuit positively and without bounce. No multiple system energizations need occur.

The novel combined hybrid circuit breaker then produces at least the following advantages:

(1) A circuit breaker is provided which is capable of switching short line faults at high voltage and extra high voltage and meets all other standard requirements of power circuit.

(2) High operating force is not needed and size and cost of the breaker is reduced.

(3) A widely variable standard design concept is available which is applicable to free standing breakers and compact substation breakers.

(4) A basic interrupting module can be formed which is rated at 145 kV or more.

(5) A breaker structure is provided with the reliability and cost at least equivalent to existing bulk oil breakers.

(6) The interrupters have essentially non-eroding characteristics.

BRIEF DESCRIPTION OF THE DRAWINGS

FIG. 1 shows a schematic diagram of the novel hybrid breaker of the present invention.

FIG. 2 illustrates the circuit interrupter characteristics of the circuit breaker of FIG. 1.

DETAILED DESCRIPTION OF THE DRAWINGS

Referring first to FIG. 1, a single phase of the novel hybrid circuit breaker of the invention is shown as connected to a pair of overhead high voltage lines 10 and 12, with the breaker contained within a housing 14. Housing 14 may be a live tank, or dead tank configuration, as desired, but is shown as a grounded dead tank for purposes of illustration.

Housing 14 has two terminal bushings 15 and 16, schematically shown, extending therefrom to bring the lines 10 and 12 into housing 14. An $SF_6$ bottle type interrupter 20 is contained within housing 20 and contains contacts 21 and 22 which are movable between relative engaged and disengaged positions within an $SF_6$ atmosphere which fills the bottle type container. The $SF_6$ interrupter 20 may be of any type well known to the art, but preferably is of the type shown in detail in copending application Serial No. 609,160, referred to above, the disclosures of which are incorporated herein by reference.

The hybrid circuit breaker next includes a vacuum bottle interrupter 30, having contacts 31 and 32 movable between relative engaged and disengaged positions. Vacuum bottle 30 may be of any well-known type and such bottles are commercially available.

The contacts 21 and 22 of interrupter 20, and contacts 31 and 32 of interrupter 30 are in series with one another and are in series with lines 10 and 12.

A suitable contact operating linkage 40, which may be supported within housing 14 by insulation support bushings 41 and 42 is then connected to contacts 21-22 and 31-32 as schematically indicated by dotted lines 50 and 51, respectively. An external operating mechanism 60, of any desired type, is then connected to operating linkage 40 by insulated shaft 61 so that, the operation of mechanism 60 to cause the rotary or axial movement of shaft 61, will cause the simultaneous opening of contacts 21-22 and 31-32. This operation can be either manually or automatically initiated. The contacts will be sequentially closed with the vacuum contacts reaching the fully closed position before the $SF_6$ contacts electrically make the circuit.

Note that the vacuum interrupter may be replaced by an $SF_6$ bottle interrupter of the type shown in copending application Ser. No. 609,160 when the arc gap is made extremely small (say less than about ¼ inch) so that the device characteristics more closely approximate those of a vacuum interrupter.

The operation of the device of FIG. 1 is as follows:

The vacuum interrupting medium of bottle 30 displays a rapid dielectric recovery capability which can provide interruption in circuits having low magnitude steep rising (ramp-type) transient voltages. However, the performance of vacuum gaps under long-term dielectric stress is not consistent. Random sparkovers across vacuum interrupters have been observed at various intervals from seconds to hours or days after a successful interruption.

The gas interrupting medium, such as $SF_6$ of interrupter 20, requires a brief interval after current zero to thermally recover dielectric strength. Upon recovery, a gap in $SF_6$ is able to withstand long-term dielectric stress without breakdown.

The $SF_6$ magnetic bottle interrupter of the type shown in the above-mentioned copending applications will have thermal recovery characteristics similar to all other $SF_6$ interrupters. Therefore, the interrupter is capable of recovering against system transient voltages that appear comparatively slower after the current zero of interruption, or transient voltages that are steep but which occur with a time delay after current zero of interruption. Therefore, on systems of 72.5 kV and below, the $SF_6$ bottle 20 alone should be able to make an interruption.

For systems of 121 kV and above, where ramp-type recovery voltage conditions exist under short-line fault conditions, the $SF_6$ bottle 20 could not accomplish an interruption by itself. For these conditions, the hybrid concept of FIG. 1 employing both the $SF_6$ bottle 20 and the vacuum interrupter 30 cooperate in a synergistic manner.

The performance of the vacuum interrupter 30 and $SF_6$ interrupter 20 in a 145 kV module is illustrated in FIG. 2. The duty imposed on the circuit breaker under short-line fault conditions is the greatest of the following:

(a) A (1-cos) function labeled in FIG. 2 having peak of 257 kV at 300 microseconds.

(b) The system transient labeled in FIG. 2 having exponential equal to 121 kV at 150 microseconds.

(c) The high-frequency, short-line fault transient labeled in FIG. 2.

The high recovery rate of the vacuum interrupter 30 is shown in curve 70 and is sufficient to withstand the transient recovery voltage requirements associated with short-line faults and system transient voltage in the first 10 to 15 microseconds after interruption. The recovery of the $SF_6$ interrupter 20 is shown in curve 71 and becomes the dominant factor at approximately 45 microseconds after interruption. This is well in advance of time (approximately 165 microseconds) when the (1-cos) voltage would exceed the capability of the vacuum gap of vacuum interrupter 30. Consequently, the hydrid breaker will now be operable under a fault condition which could not be handled by a mere cumulative addition of the characteristics of the two interrupters 20 and 30. Each interrupter 20 and 30 can have any mode of voltage distribution means that are well known in the art.

The basic hybrid interrupter of FIG. 1 may be developed on a modular basis. A single vacuum interrupter 30 (nominal 15 kV rating) in series with an $SF_6$ bottle interrupter 21 will serve as a basic module for a minimum of 145 kV service voltage. For higher voltages, including EHV and UHV levels, modules will be disposed in series combination as required for the voltage and interrupting current ratings.

The interrupter modules may be disposed in a dead tank structure suitable for application in open air-insulated or gas-insulated compact substation construction. Insulation, within the dead tank of live parts-to-ground may be with low-pressure $SF_6$ gas. Thus, in FIG. 1 the interior of tank 14 may be filled with $SF_6$ at relatively low pressure. The gas within tank 14 does not communicate with that within the bottle interrupter 20.

The interrupter units 20 and 30 of the module are physically small and compact and are of low weight and have low mass moving parts. A simple reliable spring-operating mechanism 60 can, therefore, serve as the main close/open operator.

Although the present invention has been described with respect to preferred embodiments, it should be understood that many variations and modifications will now be obvious to those skilled in the art, and it is preferred, therefore, that the scope of the invention be limited not by the specific disclosure herein, but only by the appended claims.

The embodiments of the invention in which an exclusive privilege or property is claimed are defined as follows:

1. A hybrid circuit breaker comprising in combination:

a first circuit interrupter having the interruption characteristics of a vacuum interrupter;

a second circuit interrupter having the characteristics of a sulfur hexafluoride interrupter;

first and second terminals for each of said first and second interrupters; said first and second terminals connected in series with one another;

said second interrupter comprising a pair of cooperable contacts in series with said first and second terminals of said second interrupter, and a housing for receiving said pair of contacts which is filled with sulfur hexafluoride under pressure;

operating means connected to said first and second interrupters for simultaneously operating said first and second interrupters to a circuit interrupting condition;

and a housing for enclosing said first and second interrupters; said housing being filled with a relatively low pressure dielectric gas; and bushings extending through said housing connected to said first terminals of said first and second interrupters.

2. The hybrid circuit breaker of claim 1 wherein said first interrupter comprises a vacuum bottle interrupter.

3. The hybrid circuit breaker of claim 1 wherein said first circuit interrupter has a voltage interrupting capability which is substantially less than the voltage interrupting capability of said second circuit interrupter.

4. In combination, an electrical circuit and a hybrid circuit breaker connected in series with said electrical circuit; said electrical circuit having a given recovery voltage characteristic following circuit interruption; said hybrid circuit breaker comprising in combination:

a first circuit interrupter comprising a vacuum bottle interrupter;

a second circuit interrupter comprising a pair of cooperable contacts in series with said first and second terminals of said second interrupter, and a housing for receiving said pair of contacts which is filled with sulfur hexafluoride under pressure;

first and second terminals for each of said first and second interrupters; said first and second terminals connected in series with one another;

operating means connected to said first and second circuit interrupters for simultaneously operating said first and second interrupters to a circuit interrupting condition;

said first circuit interrupter having a voltage interrupting capability considerably less than the interrupting capability of said second circuit interrupter; said first circuit interrupter having an interruption voltage recovery characteristic sufficient to withstand the recovery voltage of said electrical circuit during the initial time following a circuit interruption and for a relatively short time thereafter and at least until the interruption voltage recovery of said second circuit interrupter exceeds the recovery voltage of said electrical circuit; said second interrupter having an interruption voltage recovery characteristic such that said second interrupter is capable of withstanding the recovery voltage of said electrical circuit at a time when the recovery voltage of said electrical circuit is less than and is approaching the voltage interrupting capability of said first circuit interrupter; and a housing for enclosing said first and second interrupters; said housing being filled with a relatively low pressure dielectric gas; and bushings extending through said housing connected to said first terminals of said first and second interrupters.

5. The combination of claim 4 wherein said first circuit interrupter comprises a vacuum bottle interrupter having a nominal rating of about 15 kV and wherein said electrical circuit has a rating which is equal to or greater than about 121 kV service voltage.

* * * * *